US005373601A

United States Patent [19]

Miller

[11] Patent Number: 5,373,601

[45] Date of Patent: Dec. 20, 1994

[54] VEHICLE WASHING MITT

[76] Inventor: Dennis L. Miller, 5302 - 16th Ave., Moline, Ill. 61265

[21] Appl. No.: 944,402

[22] Filed: Sep. 14, 1992

[51] Int. Cl.[5] ..... A47L 13/12; A47K 7/02

[52] U.S. Cl. ..... 15/118; 15/227; 15/244.3; 401/7

[58] Field of Search ..... 15/118, 227, 244.3; 401/7; 51/391, 394

[56] References Cited

U.S. PATENT DOCUMENTS

| | | | |
|---|---|---|---|
| 671,296 | 4/1901 | Rowand | 15/227 |
| 1,141,580 | 6/1915 | Reddick | 15/227 |
| 1,495,389 | 5/1924 | Heimerl | 15/227 |
| 1,569,854 | 1/1926 | Doerr | 15/227 |
| 1,713,065 | 5/1929 | Williams | 401/7 |
| 2,103,455 | 12/1937 | Greenwald | 15/227 |
| 2,269,721 | 1/1942 | Johnson | 401/7 |
| 2,569,067 | 9/1951 | Livshin | 401/7 |
| 2,958,885 | 11/1960 | Donney | 15/244.3 |
| 4,287,633 | 9/1981 | Gropper | 15/244.3 |
| 4,593,427 | 6/1986 | Ortolivo | 51/391 |
| 4,621,388 | 11/1986 | Ortolivo | 51/391 |
| 4,643,386 | 2/1987 | Grzyll | 51/391 |
| 4,953,250 | 9/1990 | Brown | 401/7 |

FOREIGN PATENT DOCUMENTS

| | | | |
|---|---|---|---|
| 515580 | 11/1952 | Belgium | 15/227 |
| 550300 | 3/1923 | France | 15/227 |
| 1027690 | 2/1953 | France | 15/227 |
| 1135018 | 12/1956 | France | 401/7 |
| 2333482 | 7/1977 | France | 15/227 |
| 114265 | 3/1918 | United Kingdom | 15/227 |
| 251415 | 5/1926 | United Kingdom | 15/227 |

*Primary Examiner*—Timothy F. Simone
*Assistant Examiner*—Randall E. Chin
*Attorney, Agent, or Firm*—Robert O. Richardson

[57] ABSTRACT

A vehicle washing mitt having a tubular sleeve of non-abrasive material for wiping a vehicle with cleaning materials. The user's hand fits into the inner end of the sleeve and a mild abrasive material cannot accidentally scrape the vehicle surface. When the washing mitt is deliberately manipulated, the mild abrasive material engages the more difficult soiled spots on the vehicle.

5 Claims, 1 Drawing Sheet

VEHICLE WASHING MITT

This invention relates to vehicle washing mitts and more particularly to a mitt having water and detergent retention properties and a specific mildly abrasive area for use in removing more difficult deposits on a vehicle finish.

BACKGROUND OF THE INVENTION

Wash cloths and wet towels are used with soap and water to rub dirt and grime from the surface of vehicles. A wet soapy sponge is helpful in cleaning a difficult area. Appropriate solvents are used in removing stains, grease, chemicals and other unwanted contaminents. Rubbing a stubborn area with a slight abrasive cloth is helpful in many instances.

The problem with using so many of the above cleaning items is that they require interchangability, often resulting in the use of the wrong remedy.

Washing mitts have been developed with several types or grades of abrasive surfaces so that the user need only rotate the mitt around his hand and select the proper surface to use on the vehicle. Because of the use of several selected surfaces on the mitt, it has no thumb engagement which would control its rotational position and thus the abrasive surface to be used. Thus, it is easy to accidentally rotate the mitt to the wrong abrasive surface on the mitt. If you are washing, cleaning or polishing a vehicle fine surface with a course washing mitt surface, scratches on the vehicle surface may result. It is this accidental happening that the present invention will prevent.

SUMMARY OF PRESENT INVENTION

In accordance with the present invention a vehicle washing mitt has been developed in which a sleeve of consistent non-abrasive material is used so accidental rotational movement of the mitt on the hand of the user is of no concern. At the outer end of the mitt is an area of mild abrasive material which must be deliberately positioned to be used. It cannot be used inadvertantly on the vehicle surface since the user's fingers must be bent deliberately for the mild abrasive material to engage the vehicle surface. In this manner a wash glove is combined with a difficult stain remover in one unit.

DETAILED DESCRIPTION OF PREFERRED EMBODIMENT

Figure 1:
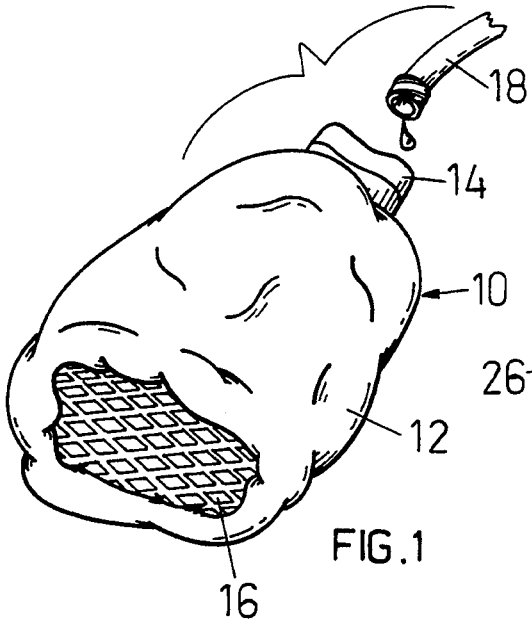
FIG. 1 is a perspective view of the Vehicle Washing Mitt.

Reference is made to FIG. 1 wherein mitt 10 is shown in its completed form. It consists of a tubular sleeve 12 of artificial lamb's wool on a porous backing with an elastic wrist band cuff 14 at its inner end and a rectangular abrasive composite sandwich 16 recessed within and enclosing the outer end. Wrist band cuff 14 is adapted to fit over the user's wrist when the user's hand is thrust into the sleeve 12. As an option a garden hose end 18 may also be inserted to insure a convenient water supply for use with the hand within the mitt.

Figure 2:
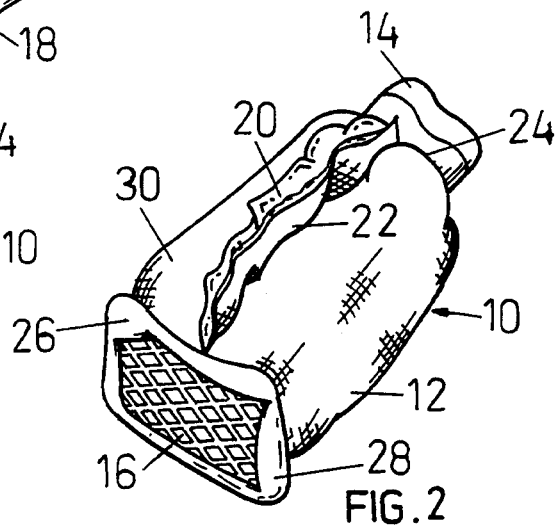
FIG. 2 is a perspective view of the Mitt turned inside out.

FIG. 2 shows the mitt 10 turned inside out to show how the tubular sleeve 12, wristband cuff 14 and the abrasive composite sandwich 16 are put together. First the rectangular piece of lamb's wool is formed into a sleeve by sewing edges 20 and 22 together. These edges are about 9 inches long. Next the elastic wrist band 14 of about 2½ inches width and 10 inches in length is sown to the inner edge 24 of sleeve 12 and the abrasive sandwich 16 is sown to the outer edge 26'. The elastic wrist band preferably is 67% polyester and 33% rubber marketed as Stretchrite Elastic by Rhode Island Textile Co., Nantucket, R.I.

Figure 3:
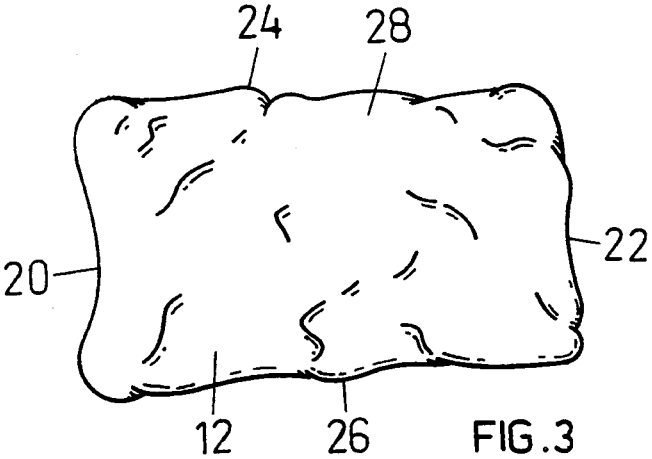
FIG. 3 shows the sleeve before conversion to tubular form.

The rectangular piece of lamb's wool 12 is shown in FIG. 3. The outer fluffy surface 28 is bonded to a porous backing 30, shown in FIG. 2. The lamb's wool having water and detergent retention properties, 12 typically is of 90% polyester and 10% acrylic material and the porous backing 30 is of 100% polyester material. One source of such lamb's wool 12 is Borge Co., Janesville, Wis.

Figure 4:
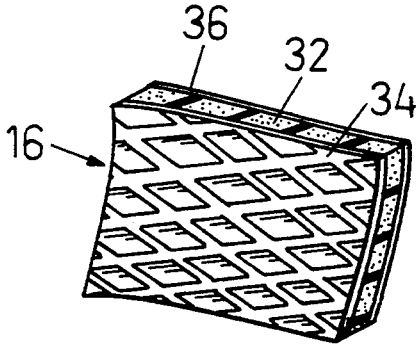
FIG. 4 shows in perspective the rectangular composite end of the Mitt before attachment.

The abrasive sandwich 16 is shown in FIG. 4. It consists of an inner layer of sponge or foam rubber 32 between outer layers 34,36 of mesh Nylon. Preferably it is a 3½×5 inch retectangle although a square or circular configuration could also be used..

In operation only the tubular sleeve 12 contacts the vehicle surface in normal washing. However, to remove bugs, stains and difficult spots, the user need only to cup his hand inside the mitt and with his fingertips apply pressure to the abrasive sandwich 16 thus causing the sandwich to be forced out of the outer end and rub it over the difficult spot.

Having described a preferred embodiment of the present invention, it is to be understood that various other versions will occur to one skilled in the art and these changes, alterations, deviations, and modifications are to be considered as part of the present invention as set forth in the appended claims.

What I claim is:

1. A vehicle cleaning mitt comprising:

a piece of porous material made into a sleeve having an inner and outer end, said sleeve having a wrist band cuff attached to said inner end defining a wrist opening, said sleeve having an abrasive composite material recessed within and enclosing said outer end, whereby said abrasive composite material can be used on the surface of a vehicle being cleaned when a user's fingers are bent, making a fist against said abrasive composite material when said fist is inserted into said sleeve and causing said abrasive composite material to be forced out of said outer end to engage the vehicle surface.

2. A vehicle cleaning mitt as set forth in claim 1 wherein said wrist band cuff is an elastic material fitting over a user's wrist when said sleeve is inserted over said user's hand.

3. A vehicle cleaning mitt as set forth in claim 1 wherein said wrist band cuff extends around said sleeve inner end and fits over a user's wrist when the user's hand is inserted into said sleeve, and wherein said composite material has an abrasive outer surface for rubbing over difficult-to-clean surfaces of a vehicle.

4. A vehicle cleaning mitt as set forth in claim 1 wherein said porous material has water and detergent retention properties.

5. A vehicle cleaning mitt as set forth in claim 1 wherein said composite material consists of outer layers of mesh nylon material, and an inner layer of porous foam sponge material between said outer layers.

* * * * *